United States Patent [19]

Barr et al.

[11] 3,996,979

[45] Dec. 14, 1976

[54] VAPOR RECOVERY NOZZLE

[75] Inventors: Robert H. Barr; Douglas L. Cheever; Thomas A. Lyons, all of Dubuque, Iowa

[73] Assignee: A. Y. McDonald Mfg. Co., Dubuque, Iowa

[22] Filed: July 8, 1974

[21] Appl. No.: 486,640

[52] U.S. Cl. ..... 141/302; 141/392

[51] Int. Cl.[2] ..... B65B 3/18; B65B 31/06

[58] Field of Search ..... 137/625.12; 141/1, 52, 141/59, 65, 93, 97, 98, 128, 198, 206–229, 290, 302, 305, 392, 86, 115, 116, 118

[56] References Cited

UNITED STATES PATENTS

| | | | |
|---|---|---|---|
| 621,149 | 3/1899 | Schalitz | 141/290 X |
| 3,566,928 | 3/1971 | Hansel | 141/97 |
| 3,719,215 | 3/1973 | Murray | 141/207 |
| 3,825,045 | 7/1974 | Bloomquist | 141/302 X |
| 3,899,009 | 8/1975 | Taylor | 141/97 X |
| 3,907,010 | 9/1975 | Burtis et al. | 141/97 X |
| 3,946,773 | 3/1976 | Hansel | 141/206 |

*Primary Examiner*—Richard E. Aegerter
*Assistant Examiner*—Frederick R. Schmidt
*Attorney, Agent, or Firm*—Wegner, Stellman, McCord, Wiles & Wood

[57] ABSTRACT

A vapor recovery nozzle for use in filling vessels with a liquid and for recovering liquid vapors generated by the liquid such as the filling of vehicle fuel tanks. The nozzle includes a valve system including a first valve for the liquid and a second valve for the vapor and an interconnection whereby the vapor valve is always open whenever the liquid valve is open. It also includes a common actuator for the two valves and an automatic shutoff system for the liquid valve, which automatic shutoff system includes a connection to the vapor line when the nozzle is being used in vacuum assisted vapor recovery systems and further forms part of a drain system for a vapor collection hood surrounding the spout of the nozzle so as to drain liquid received therein from the vapor flow path to preclude such vapor from contaminating components of a vapor recovery system.

8 Claims, 3 Drawing Figures

VAPOR RECOVERY NOZZLE

BACKGROUND OF THE INVENTION

This invention relates to vapor recovery systems and, more specifically, to vapor recovery nozzles. The most pertinent prior art known to applicants include U.S. Pat. Nos. 2,908,299; 3,521,679; 3,566,928; 3,581,782; 3,604,478; 3,710,830; 3,710,831; and 3,756,291.

Recent years have seen increasing concern over the presence of hydrocarbons in the air as a source of air pollution. One primary source of such hydrocarbons is the vapor of normally liquid petroleum products such as gasoline or diesel fuel.

Such vapors are typically found in the air space within a vessel over the liquid in the vessel and when the vessel, such as a fuel tank, is partially or wholly filled, such vapors in the air space over the liquid are forced out of the inlet of the vessel into the ambient atmosphere to thereby cause the pollution problem.

Numerous proposals have been made for constructions whereby vessels may be filled and the vapor above such liquid as may be present in the vessel captured as it is driven out of the vessel by the incoming liquid. Typically, such systems include a spout which may be introduced into the inlet of such a vessel and a hood surrounding the spout which embraces the entire periphery of the inlet. The hood is connected to a vapor recovery system so that the vapors received therein are fed through such system and removed without being discharged into the atmosphere. In some cases, the systems rely solely on the displacement of vapor within the vessel by the incoming liquid, while in other systems, a small vacuum is applied in the vapor recovery system to assist in withdrawing the vapor from the vessel.

There have also been a sizable number of proposals for valve-operated nozzles, generally intended for use on petroleum pumps at service stations, for employment in such vapor recovery systems. In general, the various proposals have failed to meet substantial acceptance. Frequently, the same are not adaptable to the wide variety of dimensions of filler tubes for fuel tanks, do not lend themselves to economic manufacture due to bulk or undue complexity, or cannot be suitably used with vapor recovery systems wherein vapor recovery elements may be contaminated by the liquid from which the vapor is formed.

SUMMARY OF THE INVENTION

It is the principal object of the invention to provide a new and improved vapor recovery nozzle. More specifically, it is an object of the invention to provide such a nozzle particularly suited for use with vapor recovery systems employed at service stations for use in recovering vapor as vehicle fuel tanks are filled.

It is also the principal object of the invention to provide such a nozzle wherein the nozzle includes a valve construction that may be economically fabricated, wherein the valve structure includes a pair of valves, one for a liquid flow path and one for a vapor flow path and the two are interconnected such that the vapor flow path will always be open whenever the liquid flow path is open to positively insure that displaced vapor from a fuel tank will be collected; wherein the nozzle may include an automatic shutoff device and may be subjected to use in a vacuum assisted vapor recovery system without adversely affecting the operation of the automatic shutoff device; and wherein means are provided to preclude contamination of components of vapor recovery systems by the liquid whose vapor is being recovered.

An exemplary embodiment of the invention achieves certain of the foregoing objects in a structure including a spout having a vapor collection hood disposed about the spout and adapted to engage substantially the entire periphery of a tank inlet when the spout is introduced into the tank. A manually operable liquid flow control valve is in fluid communication with the spout and the system includes a conduit in fluid communication with the hood for establishing a vapor flow path which may be connected to a vapor recovery device. The vapor recovery conduit includes a vapor flow control valve.

Means are associated with both such valves for causing the vapor flow control valve to open prior to and close after the opening and closing respectively of the liquid flow control valve in response to manual operation thereof so that the vapor flow path is always open to allow the passing of vapor whenever liquid is flowing into a tank into which the spout may be introduced.

In a highly preferred embodiment of the invention, both of the valves are poppet valves on a common valve stem and a lost motion connection is included between the valve stem and the liquid flow control valve to cause the above mentioned sequence of operation.

Certain others of the above mentioned objects are accomplished in a structure generally as mentioned previously in terms of the provision of a single operator for both valves which may or may not, as desired, accomplish the aforementioned sequence of operation.

Still others of the foregoing objects are accomplished in a structure as generally alluded to previously with the further provision of an automatic shutoff control for the liquid flow valve of the type employing a diaphragm operated latch for release of the manual actuator for the valves. A flow path from the vapor conduit is established to the diaphragm so as to allow the automatic shutoff to function properly when the nozzle is employed with a vacuum assisted vapor recovery system.

Still another of the foregoing objects is accomplished in a structure generally mentioned above wherein a means is provided for draining liquid within the vapor recovery hood when the nozzle is disposed in a position of non-use as, for example, when hung up on a typical gasoline pump at a service station. This feature of the invention precludes the flow of liquid through the vapor recovery line to a vapor recovery device and possible contamination of vapor recovery components therein.

In a highly preferred embodiment of the invention, this function is accomplished through the use of venturi lines associated with an automatic shutoff device for the liquid flow control valve to drain such accumulated liquid into the liquid flow path when the nozzle is in the above mentioned position of non-use.

Other objects and advantages will become apparent from the following specification taken in conjunction with the accompanying drawings.

DESCRIPTION OF THE PREFERRED EMBODIMENT

Figure 1:
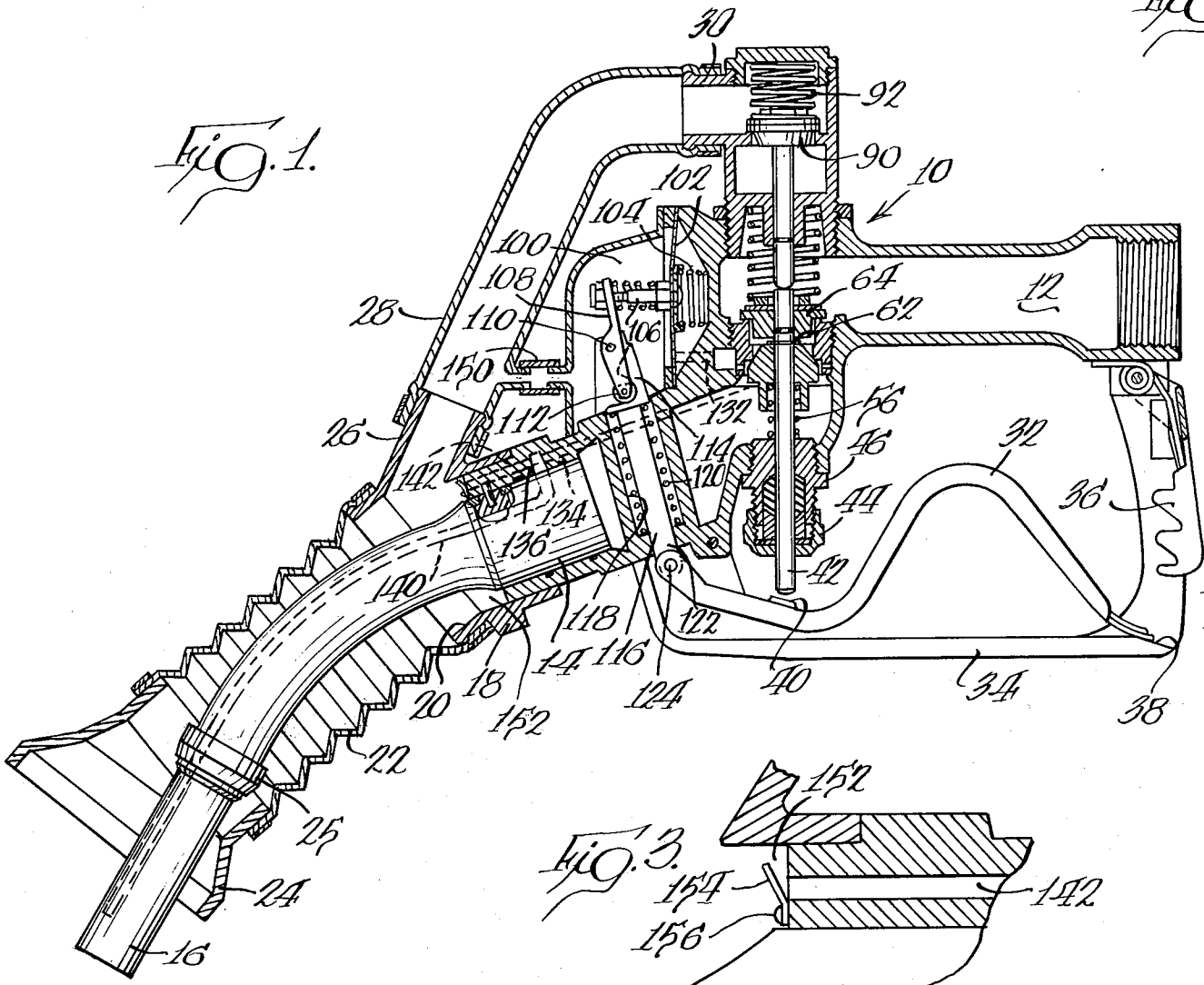
FIG. 1 is a side elevation of a vapor recovery nozzle made according to the invention with a number of components shown in section.

An exemplary embodiment of a vapor recovery nozzle made according to the invention is illustrated in the drawings, and with reference to FIG. 1, is seen to include a valve body, generally designated 10, having a liquid inlet 12 and a liquid outlet 14. Associated with the liquid outlet 14 is an elongated spout 16 which is adapted to be received in the inlet of a vessel, such as a vehicle fuel tank, to be filled.

A fitting 18 is secured by any suitable means to the valve body 10 adjacent the outlet 14 and includes an enlarged opening 20 about the spout 16. Mounted to the fitting 18 and about the opening 20 is a flexible bellows-like structure 22 formed of any suitable elastomer. Fitting 18 may be an integral part of bellows-like structure 22. Bellows 22, opposite its end secured to the fitting 18, terminates in a vapor recovery hood 24 of frusto-conical design, which is adapted to embrace the entire periphery of the inlet of a vessel to be filled when the spout 16 is introduced thereinto. Hood 24 may also be an integral portion of bellows 22. Perferably, the hood 24 is formed of a suitable elastomer with some flexibility so as to allow the same, when placed under some pressure by reason of the resiliency of the bellows 22, to conform to the shape of the inlet of the vessel as nearly as possible. The frusto-conical shape of hood 24 assists alignment of the hood with the vessel inlet. In some instances, it is desirable that a predetermined amount of pressure be applied to the hood 24 when it is engaging the inlet of a vessel and, to this end, the spout 16, intermediate its ends, may be provided with a hook-like structure 25 for engagement with the typical inturned flange found on the inlet of a fuel tank for maintaining the spout in the inlet when the nozzle is left unattended. The degree of pressure will, of course, depend upon the particular location of the hook 25.

As can be seen in FIG. 1, the cross-sectional area of the hood 24 and the bellows 22 is substantially greater than that of the nozzle 16 so as to define a fluid flow path for vapors emanating from the vessel to be filled and received within the hood 24. The vapor flow path is continued by a Y-outlet 26 on the fitting 18. A conduit 28 has one end secured to the Y-outlet 26 by any suitable means and extends upwardly from a position above the spout 16 to a fitting 30 forming part of the valve body 10 and on which the other end of the conduit 28 is received and secured by any suitable means.

The valve body 10 has mounted thereon, by means to be described in greater detail hereinafter, a valve operator 32 subject to manual actuation in the usual fashion. The operator 32 is protected by a guard structure 34. Associated with the guard structure 34 at one side thereof, is a spring loaded latch mechanism 36 of conventional configuration for latchingly receiving an end 38 of the operator 32 to latch the same in any one of a plurality of predetermined positions, all of which correspond to varying positions wherein a control valve for the flow of liquid from the inlet 12 to the spout 16 is open in varying degrees.

The operator 32, intermediate its ends, mounts a small strike plate 40 which is adapted to engage the lowermost end of a valve stem 42, which end emerges from the valve body 10, for moving the valve stem 42 to provide manual control of valves associated with the stem 42 and within the valve body 10.

Figure 2:
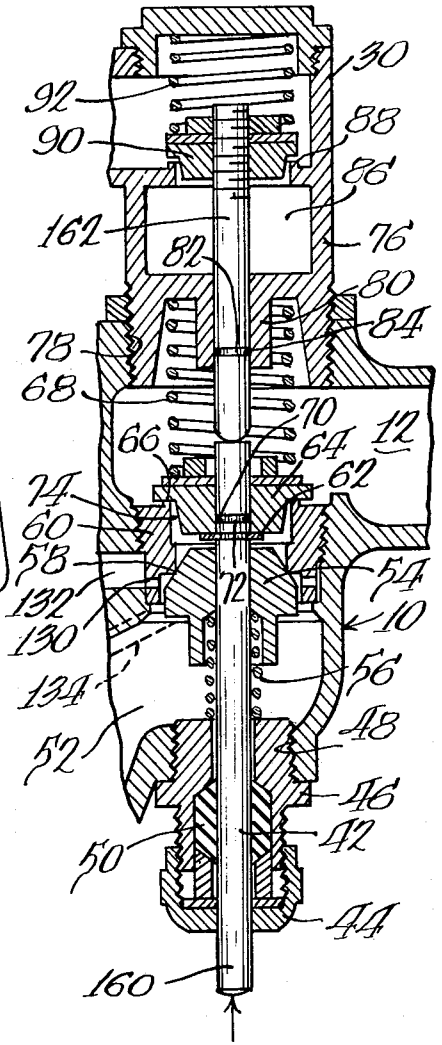
FIG. 2 is an enlarged, fragmentary, sectional view of valves employed in the nozzle.

With reference to FIG. 2, it will be seen that the valve stem 42 extends through an opening in a suitable fitting 44 which is associated with a further fitting 46 for closing an opening 48 in the valve body 10. Suitable packing 50 is disposed between the fittings 44 and 46 to establish a seal about the valve stem 42 while allowing the same to move reciprocally along its axis.

Just above the fitting 48 and within the valve body 10 is a conduit section 52 in fluid communication with the spout 16. The conduit section 52 receives a check valve 54 which is also slidably mounted on the valve stem 42 and biased upwardly by a spring 56 interposed between the underside of the check valve 54 and the upper surface of the fitting 46. The check valve 54 normally seats against a valve seat 58 on the interior of a fitting 60 threadably disposed within the valve body 10. Thus, the check valve 54 will be operative to preclude the flow of fluid from the spout 16 to the inlet 12 and yet will be openable by the pressure of fluid flowing into the inlet 12 when applied to the check valve 54 to allow such liquid to pass through the spout 16.

Above the upper surface of the check valve 54, the valve stem 42 mounts an annular washer 62 as seen in both FIGS. 1 and 2. The arrangement is such that the washer 62 is rigidly affixed to the valve stem 42 so as to move with the latter when the same is reciprocated.

Located just above the washer 62 and about the valve stem 42 is a first poppet valve 64 which acts as a liquid flow control valve. The poppet valve 64 may seat against a valve seat 66 formed on the upper surface of the fitting 60 and further is slidable on the valve stem 42. As can be seen in FIG. 1, when the valve stem 42 is in its lowermost position, the washer 62 is spaced a slight distance below the poppet valve 64. Thus, before the poppet valve 64 can be opened by reason of engagement of the washer 62 with the underside of the poppet valve 64, the valve stem 42 must be moved a slight distance upwardly.

A spring 68 engages the upper side of the poppet valve 64 to normally bias the same downwardly and in view of the fact that the poppet valve 64 is not rigidly secured to the valve stem 42, an O-ring 70 disposed in a groove 72 in the valve stem 42 to seal the interface between the valve stem 42 and the poppet valve 64 is provided.

It will also be observed from FIG. 2 that the valve 64 includes an inverted, frusto-conical surface 74 so that the cross-sectional area through which liquid may flow increases as the valve 64 is moved further away from the seat 66.

The fitting 30 includes a downturned end 76 received in a threaded bore 78 and includes a central boss 80 through which the valve stem 42 slidably extends. That portion of the valve stem 42 normally within the confines of the boss 80 for any of the positions of movement of the stem 42 includes a groove 82 for receiving an O-ring 84 to seal the interface between the valve stem 42 and the boss 80.

At the point of emergence of the valve stem 42 from the boss 80, there is a chamber 86 within the fitting 30 which serves as a vapor outlet as will be seen. By any suitable means, the chamber 86 may be placed in fluid communication with a fluid conduit to a vapor recovery device or the like.

Just above the chamber 86, an upwardly facing valve seat 88 is formed to cooperate with a second, frusto-conical poppet valve 90 which is fixedly secured to the valve stem 42. That is, the second poppet valve 90, unlike the first poppet valve 64, moves with the valve stem 42 for all positions of movement of the latter.

The poppet valve 90 serves as a vapor flow control valve for controlling the flow of vapor from the conduit 28, which it will be recalled, is in fluid communication with the hood 24, to the outlet chamber 86. A spring 92 engages the upper surface of the valve 90 for the purpose of biasing the same downwardly thereby biasing the valve stem 42 downwardly as well. Thus, the valve 90 is a normally closed poppet valve.

As can be seen in FIG. 1, with the valve stem 42 in its lowermost position, the valve 90 will be closed, thereby blocking the vapor flow conduit to a vapor recovery system. As can also be seen in FIG. 2, when the valve stem 42 is moved upwardly slightly, the valve 90 will open slightly even though the valve 64 remains closed. Further upward movement of the valve stem 42 will result in both of the valves 64 and 90 being opened, while downward movement of the valve stem will cause both valves to close with the valve 64 closing before the closing of the valve 90 by reason of the lost motion connection between the valve 64 and the stem 42 provided by the washer 62. This feature of the invention assures that the vapor flow path will always be unimpeded whenever the liquid flow path is open so as to assure collection of vapor received by the hood 24.

The vapor recovery nozzle made according to the invention preferably includes an automatic shutoff mechanism and, to this end, the valve body 10 is provided with a chamber 100 for receipt of a diaphragm 102. A spring 104 on the right side of the diaphragm 102 urges the same to the left. The diaphragm 102 also mounts an actuating rod 106 which is connected to one end of a lever 108 pivoted by a pin 110 within the chamber 100. The opposite end of the lever 108 pivotally mounts a roller 112 which may be received within a notch in a latch member 114 as illustrated in FIG. 1, the biasing of the spring 104 normally urging the roller into latching engagement with such latch.

The latch 114 is secured to a rod 116 received in a bore 118 in the valve body 10. The bore 118 also includes a spring 120 normally operative to bias the member 116 in the latch 114 upwardly within the bore 118.

The lower end 122 of the member 116 emerges from the valve body 10 and by means of pivot pin 124, pivotally mounts the end of the operator 32 opposite from the end 38.

As best seen in FIG. 2, a small passage 130 emerges into the liquid flow path just below the seat 58 for the check valve 54 and by means of a bore 132, is in fluid communication with the right-hand side of the diaphragm 102.

The nozzle also includes a passage 134 in the valve body 10 emerging into the flow path at a position not shown just below the valve seat 58 for the check valve 54 and extending towards the spout to a pocket 136. The pocket 136 is in fluid communication with a tube 140 which extends through the spout 16 to terminate just short of the end thereof.

It is also to be noted that the passage 130 includes an extension 142 to the left of the pocket 136 as best viewed in FIG. 1 to the end of the valve body 10 receiving the spout 16.

Those skilled in the art will recognize that when liquid is flowing through the liquid flow path due to the raising of the valve stem 42 in the opening of the valve 64 by manual actuation of the operator 32, a venturi-created vacuum will be generated at the passage 130. However, so long as the end of the conduit 140 is not blocked by liquid within the tank, sufficient air will pass therethrough to the area just below the valve seat 58 to preclude a substantial pressure differential being created across the diaphragm 102. However, as soon as the tank is sufficiently full so as to have liquid therein block the end of the tube 140, the venturi effect will cause a pressure differential to come into existence to thereby draw the diaphragm 102 to the right as viewed in FIG. 1, thereby pivoting the lever 108 in a clockwise direction. The strength of the springs 68 and 92 urging the valve stem 42 downwardly coupled with the resultant unlatching of the latch 114, will result in the member 116 moving downwardly with the further result that the valve stem 42 will move downwardly to close both valves.

As mentioned previously, certain vapor recovery systems have a vacuum assist and, of course, when the valve 90 is open, such a vacuum would be applied to the interior of the vessel being filled and thus the open end of the tube 140 adjacent the end of the spout 16. Such vacuum could upset the ability of the automatic shutoff system to function properly and thus, a conduit 150 interconnects the diaphragm chamber 100 and the vapor flow conduit 28 to establish fluid communication from the latter to the left side of the diaphragm 104. This, in effect, equalizes the effects of the vacuum assist so that the automatic shutoff mechanism will operate properly at all times.

Figure 3:
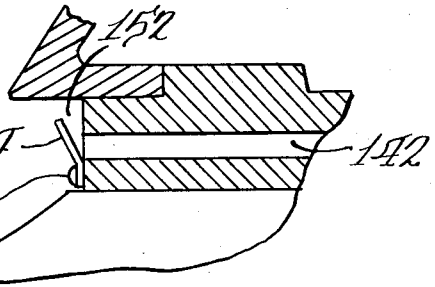
FIG. 3 is an enlarged sectional view of a part of a nozzle.

Returning now to the extension 142 of the passage 134, attention is directed to FIGS. 1 and 3. As seen in FIG. 1, the internal configuration of the fitting 18 is such that there is an annular recess 152 about the spout 16 at its point of connection to the valve body 10. Such a recess 152 will open upwardly when the nozzle is disposed in a typical position of non-use, i.e., rotated clockwise approximately 100° clockwise from the position illustrated in FIG. 1. Typically, such a position of non-use will be achieved when the nozzle is disposed on a typical support on a gasoline pump at a service station. The recess 152 serves to collect any liquid within the hood 24 of the bellows 22. Frequently, some liquid will be splashed into these elements during a tank filling operation. As long as the nozzle is in a position wherein a tank is being filled, typically that illustrated in FIG. 1, there is very little likelihood that any such liquid will be drawn through the vapor flow path to the vapor recovery system where it could contaminate elements thereof. However, once the nozzle is rotated to its position of non-use, it is possible that liquid in the hood 24 or the bellows 22 could flow into the system so that when subsequently actuated, the liquid could ultimately flow to the vapor recovery device and impede its operation.

The recess 152, however, precludes such from occurring in that it serves as a collection space for any such liquid. When the nozzle is in a typical position of non-use, any liquid within the bellows of the hood 24 will tend to flow to the lower internal surfaces thereof as illustrated in FIG. 1 and to the collection recess 152.

The conduit extension 142 serves as a drain for the recess 152 when the nozzle is in a non-use position. As best illustrated in FIG. 3, the same opens into the recess 152 so that liquid in the recess 152 may flow under the influence of gravity into the extension 142 to the passage 134 and ultimately emerge from the same to the latter's point of emergence into the liquid flow path as defined by chamber 52 just below the check valve 54.

In order to preclude the extension 142 and its opening into recess 152 from affecting the operation of the automatic shutoff device, as best seen in FIG. 3, a small flap valve 154 is provided and secured by a pin 156 or the like adjacent the open end of the extension 142. The flap valve 154 is arranged to be normally open and to close when a slight vacuum is present in the conduit 142. Thus, when the aforementioned venturi action is taking place, the slight vacuum within the passage 134 will cause the flap valve 154 to close so that automatic shutoff will occur under the circumstances previously mentioned.

According to a highly preferred embodiment of the invention, the valve stem 42 is formed of a lower stem element 160 and an upper stem element 162 which mount the poppets 64 and 90, respectively. This arrangement minimizes the effects of misalignment of the bores in the various fittings in which the stem 42 rides to minimize stem binding in operation.

From the foregoing, it will be appreciated that a vapor recovery nozzle made according to the invention is a substantial advance in the art. The exemplary embodiment minimizes the possibility of contamination of a vapor recovery system with which it may be used by providing a collection recess and a drain therefor for draining the vapor flow path. In addition, with the use of the conduit 150, the nozzle may easily be used either with vacuum assisted vapor recovery systems or other types with equal facility without affecting the automatic shutoff capabilities thereof.

The sequencing of the vapor flow control valve and the liquid flow control valve positively insures that the vapor flow path will be open whenever liquid is flowing to preclude the escape of vapor while the unique construction of locating such valves on a single actuator provides a device which can be economically manufactured and which has a minimum of bulk to thereby provide for easy use by a service station attendant or the like.

We claim:

1. In a vapor recovery nozzle for use in filling tanks with vapor forming liquid products or the like, the combination, comprising:

a spout adapted to be introduced into the inlet of a tank to be filled;

a vapor collection hood disposed about said spout and adapted to engage substantially the entire periphery of a tank inlet when said spout is introduced therein;

a manually operable liquid flow control valve in fluid communication with said spout and adapted to control the flow of liquid from a source to said spout;

means in fluid communication with said hood for establishing a vapor flow path therefrom to a vapor recovery device and including a vapor flow control valve in said flow path; and means associated with said valves for causing said vapor flow control valve to open prior to and close after opening and closing respectively of said liquid flow control valve in response to manual operation there, whereby a vapor flow path to a vapor recovery device will always be established whenever liquid is flowing to said spout;

both said valves being on a common actuator; and said means associated with said valves for causing said vapor flow control valve to open prior to and close after opening and closing respectively and said liquid flow control valve including a lost motion connection between said common actuator and said liquid flow control valve.

2. A vapor recovery nozzle according to claim 1 wherein both said valves are normally closed poppet valves and wherein said common actuator includes a valve stem fixedly secured to said vapor flow control valve and mounting said liquid flow control valve for limited relative movement.

3. A vapor recovery nozzle according to claim 2 wherein both said poppet valves are located in a common valve body.

4. A vapor recovery nozzle for use in dispensing vapor forming liquid petroleum products into tanks or the like, comprising:

a valve body having an inlet adapted to be connected to a source of a liquid petroleum product, and an outlet;

a spout mounted on said valve body and in fluid communication with said outlet for directing a liquid petroleum product from said outlet to a tank or the like;

means in said valve body defining a liquid flow path from said inlet to said outlet and including a first valve seat;

a first valve in said valve body adapted to sealingly engage said first seat to disrupt said liquid flow path;

a valve stem connected to said first valve for moving said first valve relative to said first seat and extending exteriorly of said valve body whereby said valve may be manually moved relative to said first seat;

a vapor collecting hood associated with said spout and adapted to engage the entire periphery of the inlet to a tank or the like when said spout is introduced thereinto;

a vapor flow passage in said body and in fluid communication with said hood for receiving vapor therefrom and for directing such vapor to a vapor recovery system and including a second valve seat;

a second valve in said body and adapted to sealingly engage said second valve seat to disrupt said vapor flow path;

said second valve being mounted on said valve stem and being movable therewith;

whereby said first and second valves may be substantially simultaneously moved relative to their respective seats to substantially simultaneously open or close both said liquid and said vapor flow paths;

both said first and second valves being poppet valves, and said valve stem being mounted for reciprocal movement within said valve body;

including means connecting said first valve to said valve stem for limited, lost motion movement on said stem;

said second valve is fixedly secured to said stem; and means normally closing said valves;

whereby movement of said stem to move both said valves relative to their respective seats will result in said second valve opening prior to and closing after the opening and closing respectively of said first valve to thereby assure that the vapor flow path is open whenever the liquid flow path is open.

5. A vapor recovery nozzle for use in dispensing vapor forming liquid petroleum products into tanks or the like, comprising:

a valve body having an inlet adapted to be connected to a source of a liquid petroleum product, and an outlet;

a spout mounted on said valve body and in fluid communication with said outlet for directing a liquid petroleum product from said outlet to a tank or the like;

means in said valve body defining a liquid flow path from said inlet to said outlet and including a first valve seat;

a first valve in said valve body adapted to sealingly engage said frist seat to disrupt said liquid flow path;

a valve stem connected to said first valve for moving said first valve relative to said first seat and extending exteriorly of said valve body whereby said valve may be manually moved relative to said first seat;

a vapor collecting hood associated with said spout and adapted to engage the entire periphery of the inlet to a tank or the like when said spout is introduced thereinto;

a vapor flow passage in said body and in fluid communication with said hood for receiving vapor therefrom and for directing such vapor to a vapor recovery system and including a second valve seat;

a second valve in said body and adapted to sealingly engage said second valve seat to disrupt said vapor flow path;

said second valve being mounted on said valve stem and being movable therewith;

whereby said first and second valves may be substantially simultaneously moved relative to their respective seats to substantially simultaneously open or close both said liquid and said vapor flow paths; and means for draining liquid in said hood or said vapor flow path away from said vapor flow path when said nozzle is disposed in a predetermined position corresponding to a position of non-use to thereby minimize the possibility of contamination of a vapor recovery system by liquid.

6. A vapor recovery nozzle adapted to be mounted on a flexible conduit for movement between a storage position and a plurality of liquid dispensing positions, comprising:

a spout adapted to receive liquid to be dispensed and having an end to be introduced into the inlet of a vessel to direct liquid thereinto;

a vapor collection hood about said nozzle and having an inlet end adapted to engage substantially the entire periphery of the inlet of a vessel into which said spout may be introduced and further including a vapor flow outlet adapted to be connected to a vapor recovery system;

means defining a liquid collecting recess in said hood between said inlet and said outlet and disposed to receive liquid flowing under the influence of gravity from the interior of said hood when said nozzle is in said storage position to preclude such liquid from traveling to a vapor collection system associated with said outlet;

a drain passage in fluid communication with said recess for draining said recess when said nozzle is in said storage position.

7. A vapor recovery nozzle according to claim 6 wherein said spout is mounted on a liquid flow control valve to establish a liquid flow path between said valve and said spout end, and wherein the end of said drain passage remote from said recess opens into the liquid flow path between said valve and said spout end.

8. A vapor recovery nozzle according to claim 7 wherein said valve includes a manually actuated and fluid controlled automatic shutoff means including a control fluid passage having one end opening in proximity to said spout end and another end opening into said liquid flow path between said valve and said spout end, at least a portion of said drain passage being common to at least a portion of said control fluid passage, and means for blocking said drain passage without blocking said control fluid passage whenever said valve is open.

* * * * *